US005086565A

United States Patent [19]

Cartwright

[11] Patent Number: 5,086,565

[45] Date of Patent: Feb. 11, 1992

[54] TECHNICAL DRAWING APPARATUS

[76] Inventor: Philip A. Cartwright, Wry Cottage, The Street, Ridlington, North Walsham, Norfolk NR28 9NS, England

[21] Appl. No.: 492,676

[22] Filed: Mar. 13, 1990

[51] Int. Cl.[5] ..... B43L 5/00

[52] U.S. Cl. ..... 33/1 AA; 33/403; 33/430

[58] Field of Search ..... 33/1 AA, 1 G, 430, 403; 248/444.1, 454; 108/23, 43–45, 91; 312/231; 434/88, 85, 90; D6/406, 419, 420

[56] References Cited

U.S. PATENT DOCUMENTS 858,274 6/1907 Forsyth ..... 33/430

FOREIGN PATENT DOCUMENTS 568412 4/1945 United Kingdom ..... 33/430

1002673 8/1965 United Kingdom ..... 33/1 AA

*Primary Examiner*—Harry N. Haroian

[57] ABSTRACT

Drawing apparatus for the preparation of technical drawings has a support for a drawing board on which paper may be attached. The support defines a frame surrounding the board which frame includes an upstanding lip for engagement by drawing instruments. Front, rear and side walls depend downwardly from the frame, and flare outwardly somewhat so that a series of apparatuses may be stacked for storage, with one nested partially within another. The lower edge of each side wall defines shoulders arranged so that the drawing surface may be disposed at one of three different angles to the horizontal when placed on a support surface, with that surface engaging different parts of the side walls. The frame may include an open-topped recess for holding drawing instruments, which recess will be closed by the next apparatus up, in a stack of such apparatus.

10 Claims, 8 Drawing Sheets

TECHNICAL DRAWING APPARATUS

BACKGROUND TO THE INVENTION

1. Field to the Invention

This invention relates to drawing apparatus intended in particular—but not exclusively—for the preparation of technical drawings, such as engineering drawings and the like.

2. Description of the Prior Art

There is a wide variety of drawing equipment available for use in the preparation of technical drawings, to achieve a high standard of accuracy, for obtaining and communicating technical information. Drawing boards are well known devices used in the production of engineering drawings and graphic artwork. Such boards are often used in conjunction with a variety of drawings instruments, and notably 45° and 30°–60° set squares, as well as adjustable set squares, in producing such drawings.

All commercially-available drawing boards provide a flat surface on which the working paper may be laid; many drawing boards also incorporate special means allowing the firm attachment of the paper to that flat surface, though this may often be performed with self-adhesive tape. Most commercially-available boards also allow for adjustment of the working angle of the flat surface by means of a mechanism associated with the board, below the drawing surface. Also, many commercial boards include a so-called parallel motion device which enables a horizontal line to be drawn at any place on a piece of paper supported on the flat surface. When the parallel motion device is used in conjunction with an adjustable set square, parallel lines at any angle to the horizontal may be drawn at any place on the paper.

Many commercial drawing boards are in the form of a free standing unit which may comprise a desk, or more simply just a frame, on which is supported the drawing board proper. Such a free standing unit is not easily portable and is relatively bulky. If it is likely that several people will wish to use a number of such boards at the same time, then a specialised room must be devoted to that purpose.

Other commercial drawing boards are portable devices which are intended to be placed on a flat working surface, but which may be propped to lie at some convenient angle to the working surface. Such a board may be relatively simple - and at its simplest may be little more than a rectangular piece of wood of a suitable thickness. If such a drawing board incorporates means for adjusting the working angle of the drawing surface, that usually comprises a mechanical prop arrangement attached to the underside of the board. The prop arrangement is then prone to damage when handled roughly, and makes the drawing board more awkward to transport and to store.

OBJECTS OF THE INVENTION

It is a principal object of the present invention to provide drawing apparatus in the form of a portable drawing board, which apparatus is relatively simple in its construction and yet which allows a selection of the required working angle of the drawing surface, without the use of any kind of adjustable mechanism.

It is a further object of the invention to provide drawing apparatus which is especially configured to allow a number of like drawing apparatuses to be nested one at least partially within another when none of the apparatus is required for use in the preparation of drawings.

Yet another object of this invention is the furnishing of drawing apparatus which makes special provision of the storage of drawing instruments such as pencils, rulers and pairs of compasses, whether or not the apparatus is in use.

Another object of the invention is the provision of drawing apparatus which allows the drawing of lines anywhere on a supported piece of paper which lines are all accurately oriented at the same repeatable angle to the horizontal.

The invention also has as an object a drawing apparatus which is readily portable, easy to store, robust for transport, and easy and effective to use in the preparation of technical drawings.

A further object of the invention is to provide a drawing board which is adapted for use in a workshop including a vice, which apparatus is configured to permit the board to be held by that vice, at a suitable working angle.

The invention has as yet another object a drawing apparatus which assists in the drawings of perspective views by defining a 'vanishing point' in which maybe located a drawings instrument used in drawing said views.

SUMMARY OF THE INVENTION

In accordance with the forgoing and other objects of this invention, there is provided drawing apparatus comprising means defining a substantially-flat generally-rectangular drawing surface having a front edge, a pair of side edges and a rear edge, and further comprising a pair of side walls depending downwardly from the opposed side edges of the drawing surface means. The pair of side walls flare outwardly from the side edges of the drawing surface means, so that a plurality of like drawing apparatuses may be nested one partially within another. The lower edge of each said side wall is shaped to define at least one shoulder stepped back closer to the drawing surface means than the lower edge of each side wall adjacent the front edge of the drawing surface means, the lower edge of each side wall being shaped from a location adjacent the rear edge of the drawing surface means to a location adjacent the shoulder to permit the apparatus to be placed on a support surface in one of a first disposition where the lower edges of the pair of side walls adjacent both the front and rear edges of the drawing surface means bear on the support surface, and a second disposition where the shoulder and also the lower edges of the pair of side walls nearer the rear edge bear on the support surface.

It will be appreciated that with the drawing apparatus of this invention, a drawing surface is provided which may be disposed at one of at least two angles to a support surface for the drawing apparatus, without the need for the provision of any adjustable mechanism. Moreover, when the drawing apparatus of the invention is not in use, it may be stacked in a partially-nested manner along with a number of like drawing apparatuses. In this way, the apparatus of this invention is both most convenient to use, and to when not required.

BRIEF DESCRIPTION OF THE DRAWINGS

In order that the invention may better be, it will now be described in greater detail and certain preferred features described. Also, one specific embodiment of drawing apparatus constructed and arranged in accordance with the invention will be described with reference to the accompanying drawings in which.

DESCRIPTION OF THE PREFERRED EMBODIMENTS

Figure 1:
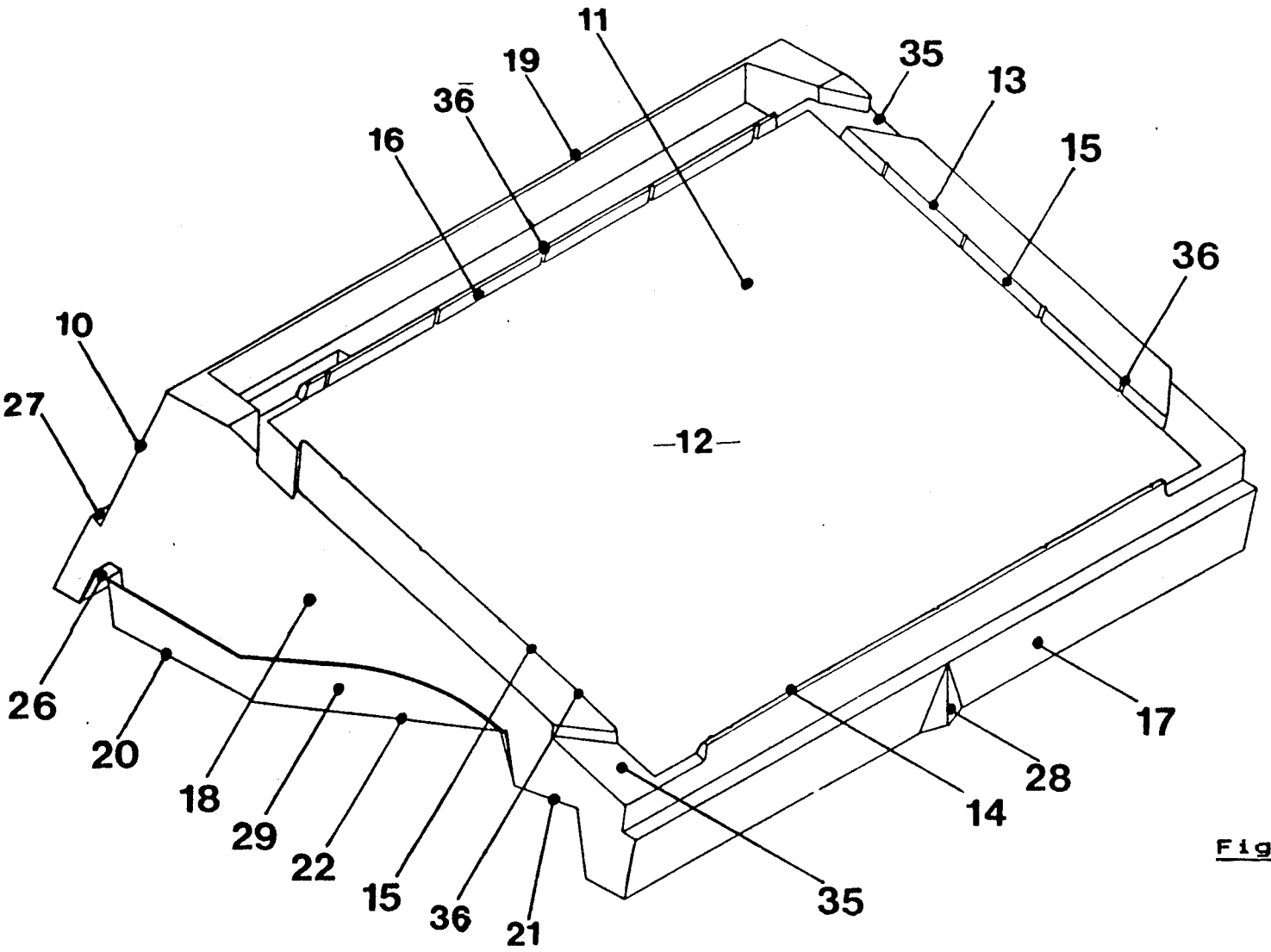
FIG. 1 is an isometric projection of the embodiment of drawing apparatus of this invention.

The drawing apparatus of this invention most preferably has each of the side walls shaped so as to define a second shoulder stepped back yet closer to the drawing surface means than the one shoulder referred to above, with the second shoulder being disposed between said one shoulder and the rear edge of the drawing surface means. In this way, the drawing apparatus may be placed on a support surface in one of three dispositions, the drawing surface lying at a different angle to the horizontal for each of those dispositions. To enhance the stability of the board, the lower edges of the pair of side walls advantageously extend at an acute angle to the plane of the drawing surface means, from a position adjacent the rear edge of the drawing surface means to the respective second shoulders.

In order to allow the use of the drawing apparatus in a workshop environment, it is preferred for there to be a bar extending between said pair of side walls which bar is disposed below the drawing surface means and which may be clamped in a bench vice. Not only does this allow the drawing apparatus securely to be clamped at a convenient position in a workshop, but moreover the drawing surface may be positioned at some convenient working angle by turning the bar in the vice before tightening the vice firmly to clamp the drawing apparatus as a whole. The bar may also include a threaded socket, permitting the apparatus to be mounted on a suitable tripod or like support.

The drawing surface means may comprise a frame defining the front edge, the pair of side edges and the rear edge, there being a separate drawing board removably located within the frame and which defines the drawing surface. Whether or not the drawing board is separate and removable from the frame, the frame may upstand from the drawing surface to define a lip extending at least partially therearound, and against which drawing instruments—such as a set square—may be engaged. In this case, the frame preferably includes indentations into which corner regions of such drawing instruments may be located, for instance when preparing perspective drawings.

The frame may include various recesses for drawing instruments which recesses are bound by upstanding walls defining one or more open-topped holders, which open-topped holders are effectively closed when the drawing apparatus is nested within another like drawing apparatus.

In order to protect the drawing surface and any partially-completed drawing thereon, it is preferred for there to be provided a lid adapted to overlie at least the drawing surface means, but possibly also any recesses for drawing instruments, which lid is movable from a position at which said lid overlies at least the drawing surface means to a second position where the lid generally upstands from the rear edge of the drawing surface means to define a copy board for holding working papers.

In addition to the pair of side walls, the drawing apparatus may include a front wall and a rear wall, both depending downwardly respectively from the front edge and the rear edge of the drawing surface means, and which front and rear walls conjoin with the pair of side walls. The front wall preferably is provided with means to receive a peg extending generally horizontally from a wall, whereby the drawing apparatus may be hung from that peg to provide a useful drawing surface at an angle to the wall. In addition to, or instead of, the receiving means of the front wall, an aperture may be provided in that wall to serve as a hand-hold.

The preferred embodiment of drawing apparatus of this invention and illustrated in the drawings will now be described in detail. This apparatus comprises a support 10 for a drawing board 11 defining a drawing surface 12, the board preferably being removable from the support 10. The support 10 includes a frame 13 extending around the drawing surface 12 of the board 11, which frame 13 defines a front edge 14, a pair of side edges 15 and a rear edge 16.

Depending downwardly from the front edge 14, side edges 15 and rear edge 16 are, respectively, a front wall 17, a pair of side walls 18 and a rear wall 19. The front wall 17 has a shallower depth than the rear wall 19, such that when the drawing apparatus is placed on a substantially horizontal surface, the drawing surface 12 lies at an acute angle to that surface, as shown in FIG. 4A.

Figure 3:
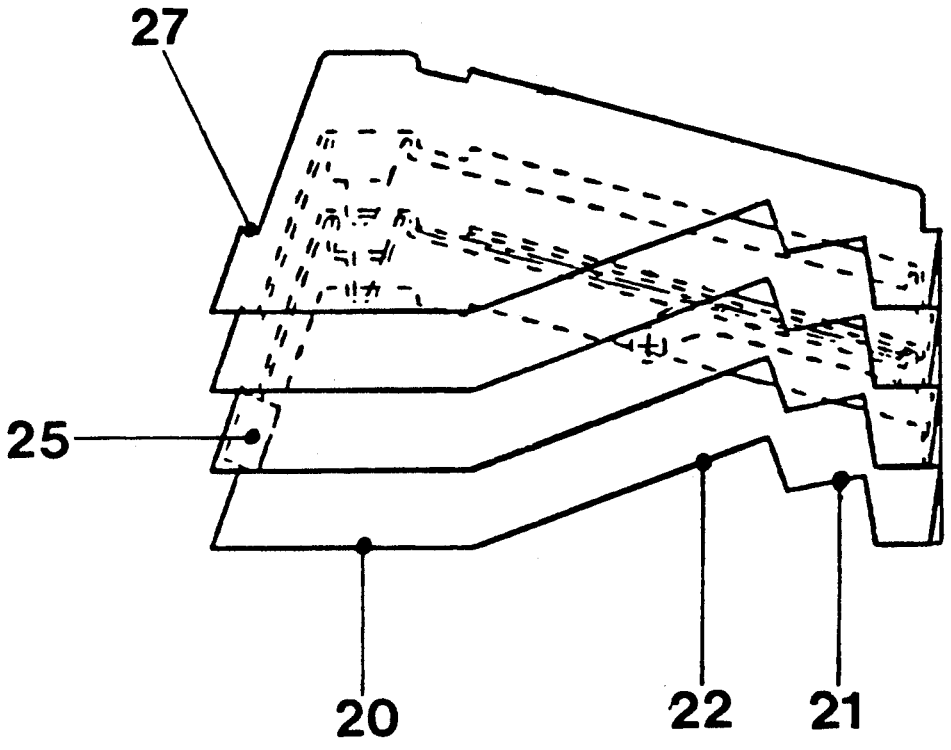
FIG. 3 is a side elevation of four drawing boards apparatuses stacked one on another, each board being as illustrated in FIG. 1.
Figure 4A:
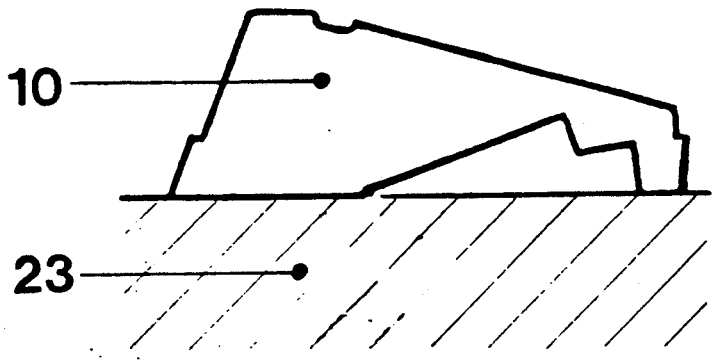
FIGS. 4A, 4B, and 4C show the drawing apparatus of FIG. 1 in use, respectively at three different angles to a support surface.
Figure 4B:
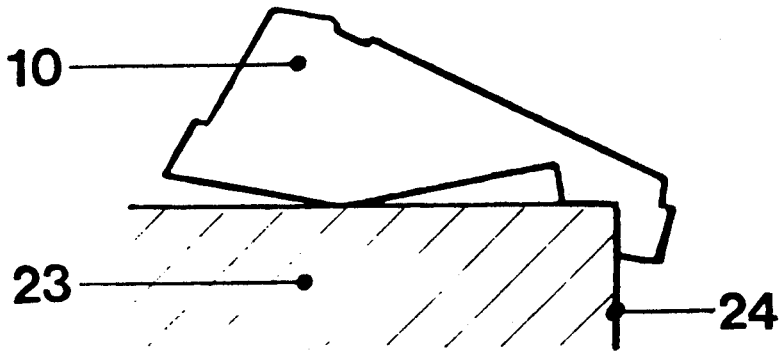
Figure 4C:
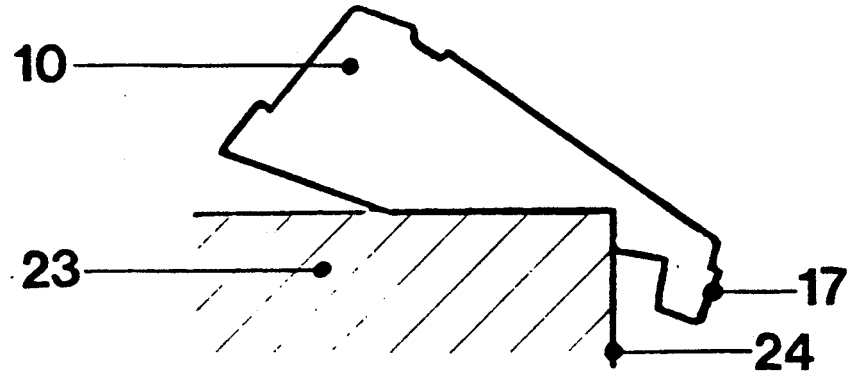

The lower edges 20 of both side walls 18 are shaped as best seen in FIGS. 3 and 4, so as to provide a first shoulder 21 stepped closer to the drawing surface 12 than the bottom edge of the front wall 17, and a second shoulder 22 even yet closer to the drawing surface 12 and disposed between the first shoulder 21 and the rear wall 19. From each second shoulder 22, the respective lower edge of the side wall continues at an increasing distance from the drawing surface 12, until blending with the lower edge of the side wall 18 adjacent the rear wall 19. This configuration of the lower edges 20 of the side walls 18 allows the drawing board to be placed on a support surface 23 in any one of the three dispositions, shown respectively in FIGS. 4A, 4B and 4C. In the first disposition, the support surface is contacted principally by the lower edges 20 of the side walls 18 adjacent the front and rear walls 17 and 19, but also by the front and rear walls 17 and 19; but in FIG. 4B the support surface is contacted by the first shoulder 21 and by the lower edges 20 of the side walls 18 nearer the rear wall 19: this gives a drawing surface 12 at a more acute angle to the horizontal than the position illustrated in FIG. 4A. If a yet more acute angle is required for the drawing surface 12, then the support surface 23 is contacted by the second shoulder 22 and by the lower edges 20 of the side walls 18 extending from that shoulder 22 towards the rear wall 19, as illustrated in FIG. 4C. In the case of FIGS. 4B and 4C, the apparatus must be used along a corner edge of the support surface 23, such that the corner edge 24 may be engaged by the respective shoulder 21 or 22.

The front wall 17, side walls 18 and rear wall 19 all flare outwardly slightly from the frame 13, whereby the drawing apparatus may be nested at least partially within a like drawing apparatus, as illustrated in FIG. 3. A solid bar 25 extends internally transversely across the rear wall 19, and is held in place by projections 26 in the side walls 18; when the apparatus is stacked on another, this bar 25 rests on a ledge 27 also formed in the rear wall 19 but externally thereof, in each board.

The front wall 17 has a recess 28 which is adapted to receive a peg projecting horizontally from a wall (not shown), to allow the drawing apparatus to be suspended from that peg with the front wall 17 uppermost; this provides a drawing surface 12 at a convenient angle. A aperture (not shown) may also be formed in the front wall to serve as a hand-hold, for carrying purposes.

Figure 2:
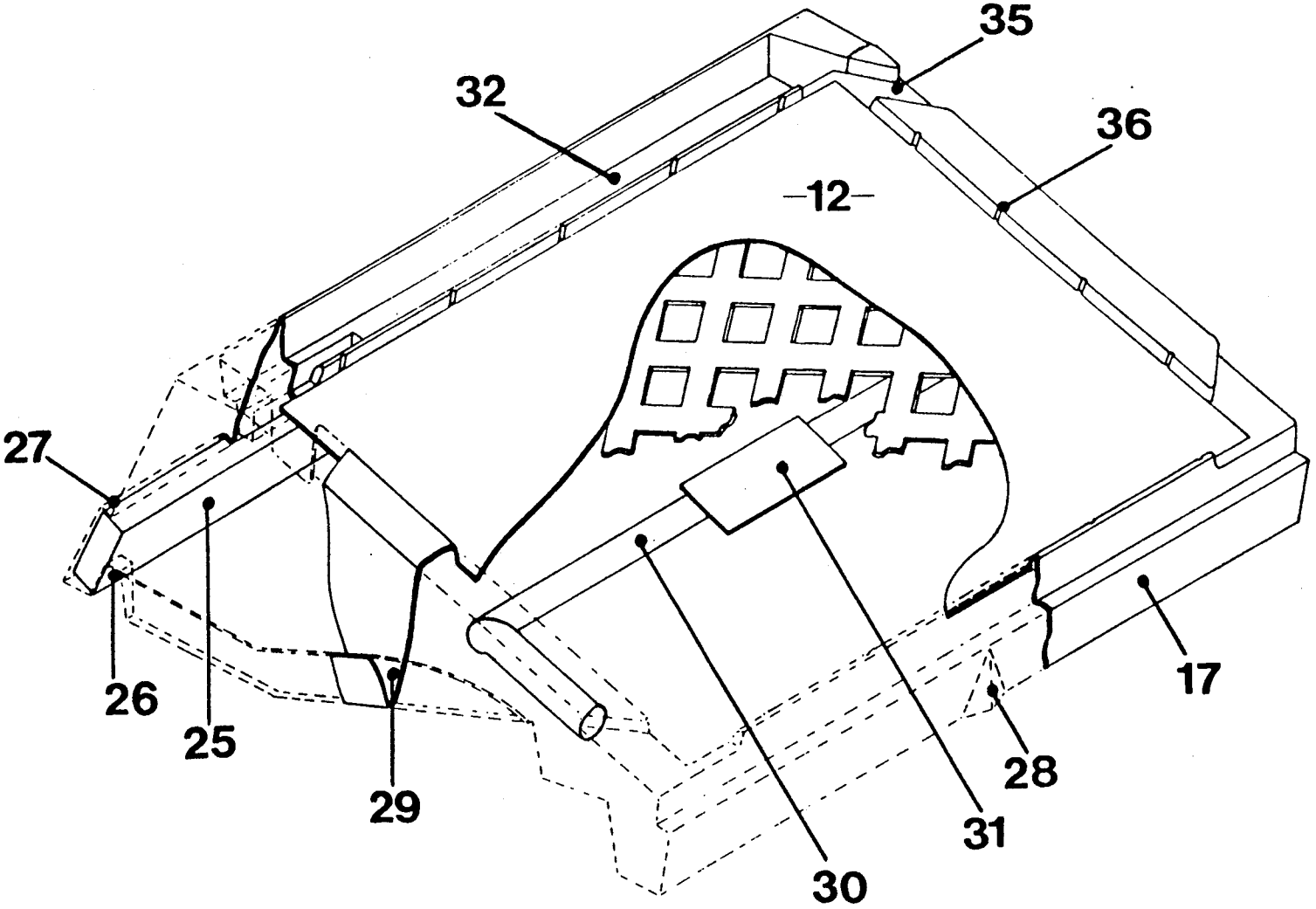
FIG. 2 is a further isometric projection of the drawing apparatus of FIG. 1, but with certain parts cut away for clarity.

Also illustrated in FIGS. 1 and 2 is a pocket 29 formed on a side wall 18, the pocket 29 being arranged to hold a set square generally parallel to that side wall 18, when the board is in use.

A tubular frame 30 extends between the side walls 18, immediately below the drawing surface 12, the frame including a centrally-disposed flat plate 31. The tubular frame can be clamped in a metal-worker's vice enabling the drawing board to be held at any convenient working angle. The plate 31 serves to prevent the frame dropping through the jaws of the vice during adjustment of the working angle.

Figure 7:
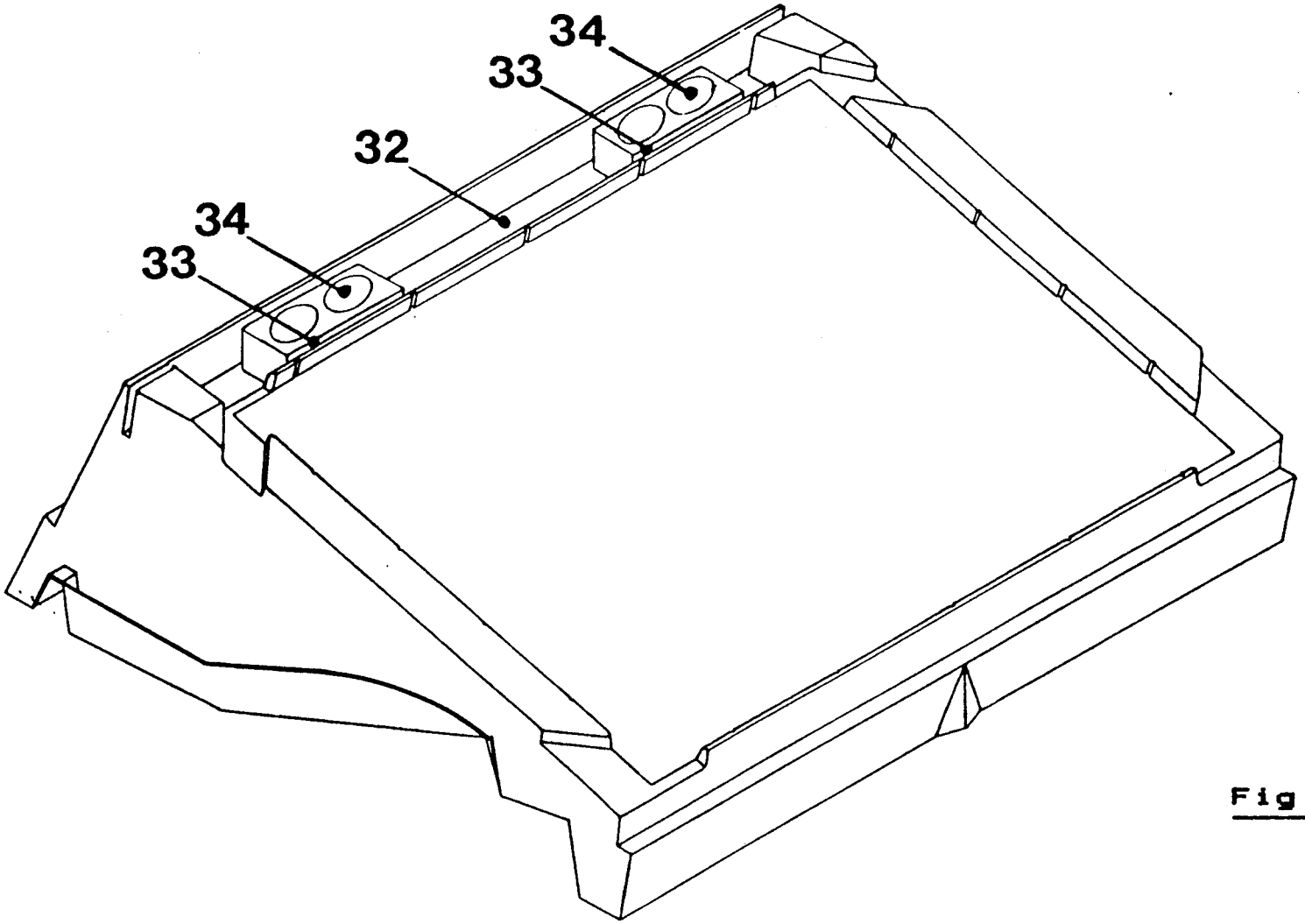
FIG. 7 is perspective view on an enlarged scale of part of an alternative form of drawing apparatus of this invention.

Along the top of the rear edge 16 of the frame 13, there is provided a recess 32 for accommodating drawing instruments; an alternative form of recess is illustrated in FIG. 7 which includes a slot 33 for a ruler, and holes 34 for pencils. When one drawing apparatus is stacked on another, the recess 32 of the lower drawing apparatus is effectively closed by the upper drawing apparatus, so securely holding in place any instruments located in the recess.

The frame 13 has further recesses 35 adjacent the corners thereof, which allow paper to be attached to the drawing surface 12 at the corners thereof, for example by means of self-adhesive tape. Also, the frame 13 includes indentations 36 which may be used to locate the corner of a set square and so to aid in the production of perspective drawings, by providing vanishing points.

Figure 5:
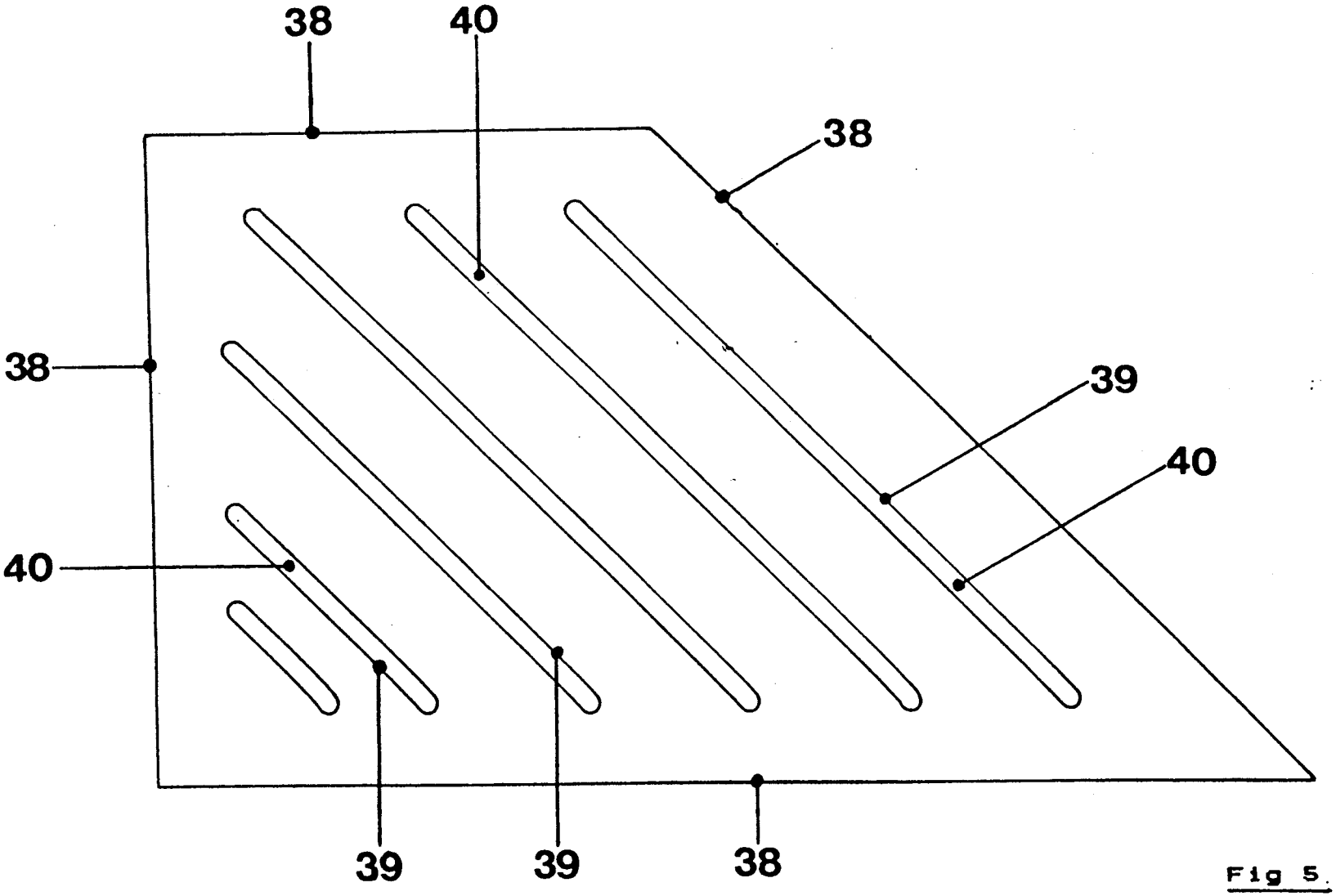
FIG. 5 shows a 45° set square for use with the drawing apparatus of FIGS. 1 to 4.

Referring to FIG. 5, there is shown a special form of set square for use with the drawing apparatus described above, enabling the drawing of lines horizontally, vertically and at 45° to the horizontal at any place on the drawing surface 12. This set square 37 may be pressed against any of the frame edges 14, 15, 16, and lines may be drawn along the outside edges 38 of the set square, or along the edges 39 of the slots 40 therein.

Figure 6:
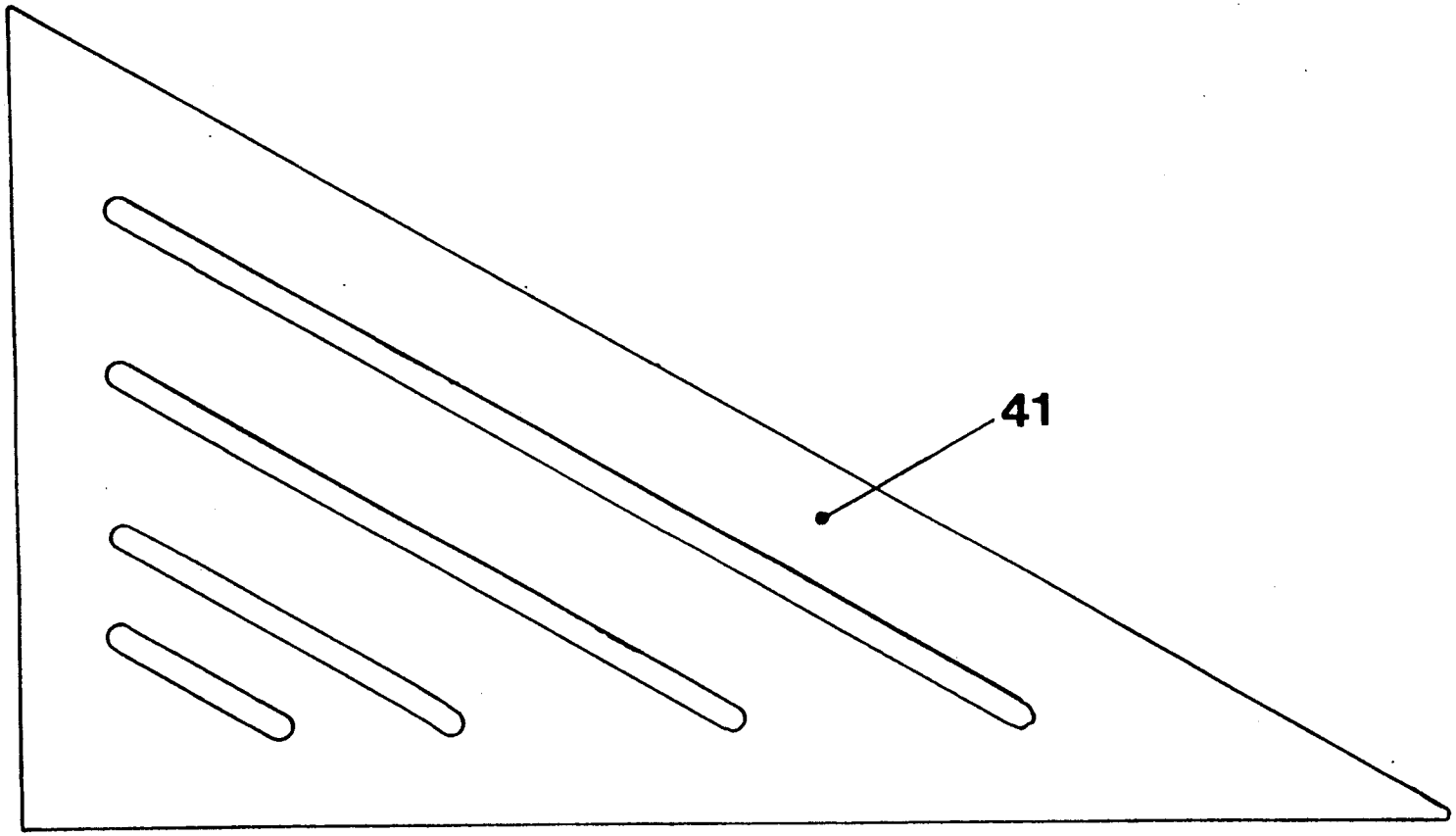
FIG. 6 shows a 30°-60° set square for use with the drawing apparatus.

FIG. 6 shows a 30°–60° set square which otherwise is somewhat similar to the 45° set square of FIG. 5. Again, this set square 41 may be engaged against any of the edges of the frame 13 and then used to draw lines horizontally, vertically and at 30° or 60° to the horizontal, at any place on the drawing surface.

Figure 8:
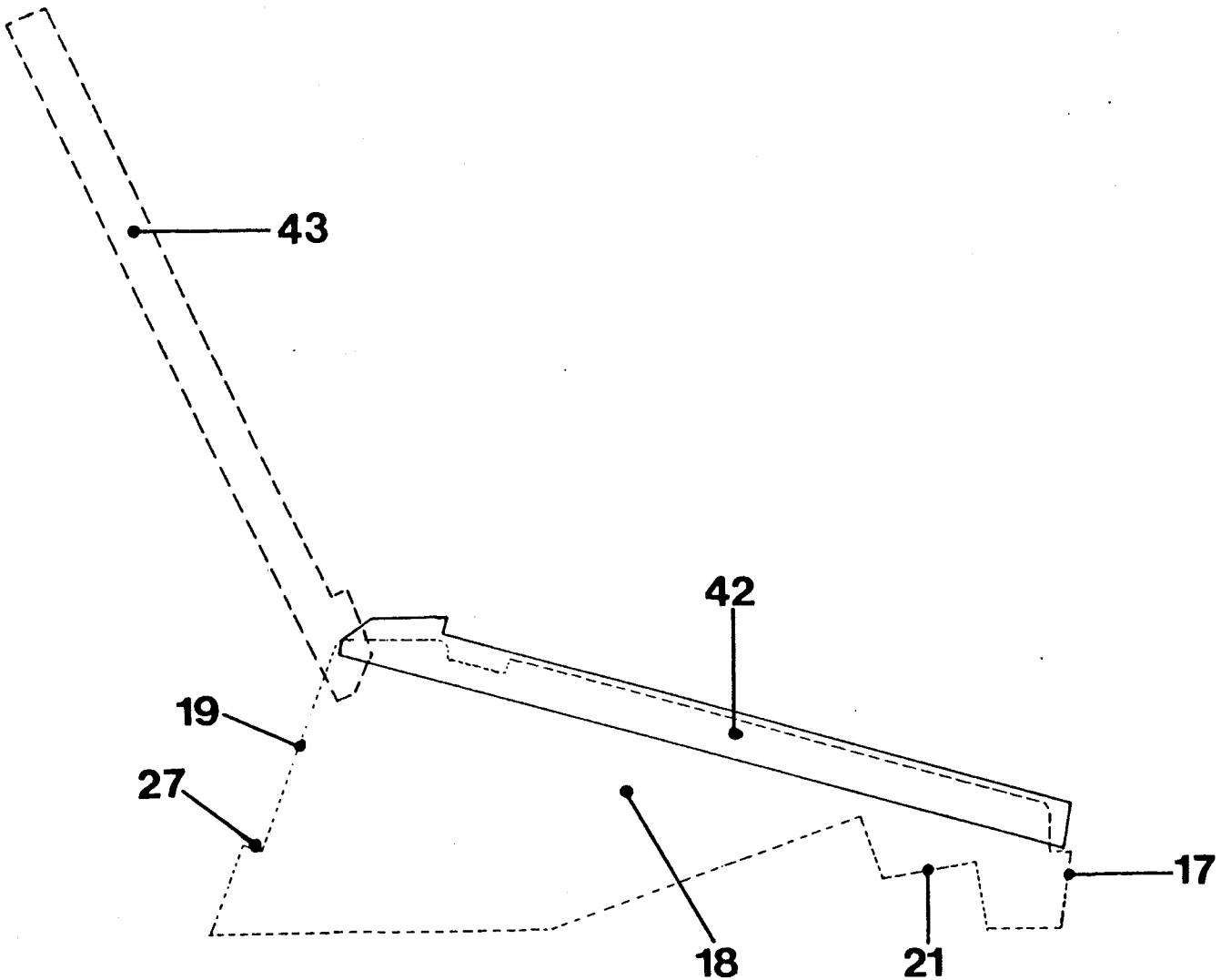
FIG. 8 is a diagrammatic side view of a modified form of the embodiment of drawing apparatus of this invention.

FIG. 8 diagrammatically illustrates a modified form of drawing apparatus of this invention. This apparatus is essentially the same as that described above, except that it includes a lid 42 adapted to overlie the drawing surface 12 but preferably also recess 32, when the surface is not in use. When the surface is to be used, the lid 42 may be moved to the position shown in phantom lines 43 where the lower edge of the lid 42 is engaged with a recess (not shown) formed along the rear edge 16 of the frame 13, whereby the lid 42 may serve as a copy stand for working papers.

Many other variants of this invention will readily be apparent to those skilled in the art, without departing from the spirit and scope of the inventive concept, as defined in the appended claims.

What I claim is:

1. Drawing apparatus comprising means defining a substantially-flat generally-rectangular drawing surface having a front edge, a pair of side edges and a rear edge, and further comprising a pair of side walls depending downwardly from the opposed side edges of the drawing surface means, which said pair of side walls flare outwardly from said side edges of the drawing surface means whereby a plurality of like drawing apparatuses may be nested one partially within another, and the lower edge of each said side wall being shaped to define at least one shoulder stepped back closer to the drawing surface means than the lower edge of each side wall adjacent the front edge of the drawing surface means, the lower edges of each said side walls being shaped from a location adjacent the rear edge of the drawing surface means to a location adjacent said shoulder to permit the apparatus to be placed on a support surface in one of a first disposition where the lower edges of said pair of side walls adjacent both said front and rear edges of the drawing surface means bear on the support surface, and in a second disposition where the shoulder and also the lower edges of said pair of side walls nearer the rear edge bear on the support surface.

2. Drawing apparatus according to claim 1, wherein said lower edge of each said side walls is shaped to define a second shoulder stepped back yet closer to the drawing surface means than said one shoulder, said second shoulder being disposed between said one shoulder and the rear edge of said drawing surface means.

3. Drawing apparatus as claimed in claim 2, wherein said lower edges of said pair of side walls extend at an acute angle to the plane of said drawing surface means, from a position adjacent the rear edge of the drawing surface means to said respective second shoulders.

4. Drawing apparatus as claimed in claim 1, wherein a bar extends between said pair of side walls which bar is disposed below the drawing surface means, and which bar may be clamped in a bench vice to support the drawing apparatus at a desired angle.

5. Drawing apparatus as claimed in claim 1, wherein said drawing surface means comprises a frame defining said front edge, said pair of side edges and said rear edge, the drawing surface means further comprising a drawing board separate from but removably locatable within said frame and defining the drawing surface.

6. Drawing apparatus as claimed in claim 1, wherein said drawing surface means comprises a drawing board defining a drawing surface and a frame extending at least partially around said board, the frame upstanding from said surface to define a lip against which drawing instruments may be engaged.

7. Drawing apparatus as claimed in claim 6, wherein said frame includes regions coplanar with said drawing surface whereby parts of drawing instruments used with said drawing apparatus may be located within said regions.

8. Drawing apparatus as claimed in claim 6, wherein said frame includes at least one recess bound by upstanding walls to define open-topped holders for drawing instruments, which at least on open-topped holder is effectively closed when said drawing apparatus is nested within another like drawing apparatus.

9. Drawing apparatus as claimed in claim 1, wherein there is provided a lid adapted to overlie the drawing surface means, which lid is movable from a first position at which said lid overlies at least said drawing surface means to a second position where said lid upstands from said rear edge of said drawing surface means to define a copy board for holding working papers.

10. Drawing apparatus according to claim 1, wherein there is provided a front wall and a rear wall depending downwardly from said front edge and said rear edge respectively of said drawing surface means, said front wall and said rear wall being conjoined with said pair of side walls depending from said side edges of said drawing surface means.

* * * * *